US005480704A

United States Patent [19]

Sogabe

[11] Patent Number: 5,480,704

[45] Date of Patent: Jan. 2, 1996

[54] THERMAL TRANSFER PRINTING MEDIUM

[75] Inventor: Jun Sogabe, Osaka, Japan

[73] Assignee: Fujicopian Co., Ltd., Japan

[21] Appl. No.: 308,598

[22] Filed: Sep. 19, 1994

[30] Foreign Application Priority Data

Sep. 20, 1993 [JP] Japan ..... 5-233518
Mar. 22, 1994 [JP] Japan ..... 6-050550

[51] Int. Cl.[6] ..... B41M 5/26

[52] U.S. Cl. ..... 428/212; 428/195; 428/484; 428/488.1; 428/488.4; 428/500; 428/516; 428/522; 428/913; 428/914

[58] Field of Search ..... 428/195, 212, 428/522, 484, 488.1, 488.4, 913, 914, 500, 516

[56] References Cited

U.S. PATENT DOCUMENTS 4,840,837 6/1989 Tanaka et al. ..... 428/216
4,894,288 1/1990 Fukuda et al. ..... 428/422

FOREIGN PATENT DOCUMENTS 1-118484 5/1989 Japan ..... B41M 5/26

OTHER PUBLICATIONS

*Patent Abstracts of Japan,* vol. 13, No. 360 (M-858), published Aug. 11, 1989 citing Japanese patent 01,118,484, published May 10, 1989.

*Primary Examiner*—Pamela R. Schwartz
*Attorney, Agent, or Firm*—Fish & Neave

[57] ABSTRACT

A thermal transfer printing medium is provided which includes a foundation, a release layer containing a wax, a first thermal transfer layer comprising a heat-meltable material containing 20 to 100% by weight of a resin having a glass transition point of not lower than 50° C. and a melt viscosity of not higher than $1\times10^4$ cps/160° C., and a second thermal transfer layer comprising a heat-meltable material and having a melt viscosity of not lower than $1\times10^5$ cps/160° C., the release layer, the first thermal transfer layer and the second thermal transfer layer being stacked in this order on the foundation, at least one of the first and second thermal transfer layers containing a coloring agent. The thermal transfer printing medium is improved in image fixability with its bridging transferability maintained and thereby assures clear and firm print images free of voids and dropout portions even on a rough paper sheet with a low printing energy.

3 Claims, No Drawings

THERMAL TRANSFER PRINTING MEDIUM

BACKGROUND OF THE INVENTION

The present invention relates to a thermal transfer printing medium capable of forming dear print images on a paper sheet of poor surface smoothness (hereinafter referred to as "rough paper").

Conventional thermal transfer printing media of this type are each provided with a bridgingly transferable ink layer. Such an ink layer has a high melt viscosity which is capable of being transferred as bridging over depressed portions of a rough paper while adhering not to the depressed portions but only to projecting portions thereof.

Such a bridgingly transferable ink of a high melt viscosity, however, is poor in permeating property with respect to paper. In transfer printing on a rough paper in particular, the ink adheres only to projecting portions (compared to depressed portions) of the rough paper; therefore, the poor penetrability of the ink results in print images of significantly degraded fixability, which leads to poor abrasion resistance or the like.

It is conceivable, as means for improving the fixability of print images, that the penetrability of ink is enhanced by using a higher printing energy. This, however, results in a difficulty in high-speed printing and wasteful energy consumption.

To maintain the printing energy to a certain level, the ink layer has to be incorporated with a material of good penetrability. The incorporation of such a material reduces the melt viscosity of the ink layer, thus leading to the ink layer exhibiting unsatisfactory bridging transferability.

Thus, the bridging transferability is inconsistent with the fixability if the printing energy is suppressed.

In view of the foregoing, an object of the present invention is to provide a thermal transfer printing medium which assures print images of improved fixability while maintaining satisfactory bridging transferability, thereby enabling the formation of clear print images of satisfactory fastness free of void or drop out portion even on a rough paper with less printing energy.

This and other objects of the present invention will be apparent from the following detailed description.

SUMMARY OF THE INVENTION

According to the present invention, there is provided a thermal transfer printing medium comprising a foundation, a release layer containing a wax as a major component, a first thermal transfer layer comprising a heat-meltable material containing 20 to 100% by weight of a resin having a glass transition point of not lower than 50° C. and a melt viscosity of not greater than $1\times10^4$ cps/160° C., and a second thermal transfer layer comprising a heat-meltable material and having a melt viscosity of not less than $1\times10^5$ cps/160° C., the release layer, first thermal transfer layer and second thermal transfer layer being stacked on the foundation in this order, at least one of the first and second thermal transfer layers containing a coloring agent.

Preferably, the resin contained in the heat-meltable material of the first thermal transfer layer comprises at least one resin selected from the group consisting of petroleum resins, phenol resins, acrylic resins, styrene resins, styrene-acrylic monomer copolymers, rosin resins, pinene resins, coumarone-indene resins, and copolymers thereof.

Further, preferably, the heat-meltable material of the second thermal transfer layer contains 50 to 100% by weight of an ethylene-vinyl acetate copolymer having a content of vinyl acetate of not greater than 20% by weight.

In the present invention the second thermal transfer layer is a transferable ink layer of high melt viscosity exibiting a bridging transferability which exhibits a high adhesive strength immediately when softened but which is poor in fixability due to poor penetrability with respect to paper.

On the other hand, the first thermal transfer layer is of low melt viscosity and hence exhibits good penetrability with respect to paper and can be assuredly fixed when solidified (since the resin having a glass transition point of not lower than 50° C. is hard at room temperature). This fixing property of the first thermal transfer layer does not appear until the layer is solidified.

When printing is performed on a rough paper sheet using the thermal transfer printing medium of the present invention having such first and second thermal transfer layers stacked in this order from the foundation side, a heated portion of the first thermal transfer layer turns into a melt of low viscosity, penetrates through the second thermal transfer layer and permeates projecting portions of the rough paper sheet. At the time of release of the thermal transfer printing medium from the rough paper sheet, the adhesive strength of the second thermal transfer layer permits the transfer layers to transfer onto the paper sheet though the resin of the first thermal transfer layer having permeated the rough paper sheet is not yet solidified. After the transfer is completed, the resin of the first thermal transfer layer having permeated the paper sheet solidifies thereby enhancing the adhesion of the print images to the paper sheet. It should be noticed that the mechanism of the resin of the first thermal transfer layer penetrating through the second thermal transfer layer is not determined yet.

Thus, the thermal transfer printing medium of the present invention is excellent in both bridging transferability and fixability. In addition, since the first thermal transfer layer can be softened and melted with ease, high-speed printing is feasible without the need of enhancing the printing energy.

It takes a relatively long time for the first thermal transfer layer in a melted state to solidify. Accordingly, if the first thermal transfer layer is provided on the second thermal transfer layer, high-speed priting becomes infeasible.

In the present invention the second thermal transfer layer has a high melt viscosity and hence inherently exhibits a high scumming preventability. The scumming preventability of the second thermal transfer layer is further improved if the coloring agent is not contained therein.

As a matter of course, the thermal transfer medium of the present invention is also capable of forming satisfactory print images on a smooth paper sheet by virtue of its excellent fixability.

DETAILED DESCRIPTION

The present invention will now be described in detail.

In the present invention the second thermal transfer layer is of the same type as the conventionally known transferable ink layer exhibiting bridging transferability. The second thermal transfer layer comprises a heat-meltable material and optionally a coloring agent and has a melt viscosity of not lower than $1\times10^5$ cps/160° C.

If the melt viscosity of the second thermal transfer layer is lower than $1\times10^5$ cps/160° C., the bridging transferability degrades so that voids or dropout portions are likely in print images on a rough paper. The upper limit of the melt viscosity thereof is not particularly limited but is preferably about $1\times10^9$ cps/160° C. in view of transfer sensitivity.

The heat-meltable material of the second thermal transfer layer contains a heat-meltable resin (including an elastomer, hereinafter the same) as a major component thereof, and may be incorporated with a minor amount of a wax as required. The heat-meltable material is preferably composed of solely a heat-meltable resin.

Examples of such heat-meltable resins include ethylene copolymers such as ethylene-vinyl acetate copolymer, ethylene-vinyl butyrate copolymer, ethylene(meth)acrylic acid copolymer, ethylene-alkyl (meth)acrylate copolymer wherein examples of the alkyl group are those groups having 1 to 16 carbon atoms, such as methyl, ethyl, propyl, butyl, hexyl, heptyl, octyl, 2-ethylhexyl, nonyl, dodecyl and hexadecyl, ethylene-acrylonitril copolymer, ethylene-acrylamide copolymer, ethylene-N-methylolacrylamide copolymer and ethylene-styrene copolymer; poly(meth)acrylic acid esters such as polydodecyl methacrylate and polyhexyl acrylate; vinyl chloride polymers and copolymers such as polyvinyl chloride, vinyl chloride-vinyl acetate copolymer and vinyl chloride-vinyl alcohol copolymer; and in addition thereto polyester resins, polyamide resins, cellulosic resins, natural rubber, styrene-butadiene copolymer, isoprene polymer and chloroprene polymer. These resins may be used either alone or as a mixture. The polyester resins are those obtained by polycondensation of an acid component and a diol component. Examples of the acid component include saturated dibasic acids such as phthalic acid, phthalic anhydride, sebacic acid and azelaic acid; unsaturated dibasic acids such as maleic anhydride and fumaric acid; and dimer acids. These acids may be used either alone or in combination of two or more species. Examples of the diol component include ethylene glycol, propylene glycol, decanediol, dodecanediol, hexadecanediol, and bisphenol compounds and adducts of the bisphenol compound with ethylene oxide and/or propylene oxide. These diols may be used either alone or in combination of two or more species. Among the foregoing resins, ethylene-vinyl acetate copolymer is particularly preferable in view of its high melt viscosity and excellent adhesiveness.

Examples of the wax include natural waxes such as haze wax, bees wax, carnauba wax, candelilla wax, montan wax and ceresine wax; petroleum waxes such as paraffin wax and microcrystalline wax; synthetic waxes such as oxidized wax, ester wax, polyethylene wax, Fischer-Tropsch wax and α-olefin-maleic anhydride copolymer wax; higher fatty acids such as myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as stearic acid amide and oleic acid amide. These waxes may be used either alone or as a mixture.

The heat-meltable material of the second thermal transfer layer preferably contains 50 to 100% (by weight, hereinafter the same) of an ethylene-vinyl acetate copolymer having a content of vinyl acetate of not greater than 20%.

The ethylene-vinyl acetate copolymer of which the content of vinyl acetate is not greater than 20% usually has a softening point within the range of 70° to 100° C., which is higher than that of an ethylene-vinyl acetate copolymer of which the content of vinyl acetate is greater than 20%.

Accordingly, by incorporating 50 to 100% of such ethylene-vinyl acetate copolymer into the heat-meltable material it is possible to raise the softening point of the second thermal transfer layer, for example, to within the range of 60° to 100° C.

If the content of vinyl acetate is too small, the softening point of ethylene-vinyl acetate copolymer becomes too high and, hence, the transfer sensitivity of the second thermal transfer layer is degraded. Therefore, the content of vinyl acetate is preferably not less than 10%.

The second thermal transfer layer having such a high softening point enjoys an advantage of keeping a receptor paper sheet from scumming even in continuous printing.

Specifically, when the heat-meltable ink layer used has a relatively low softening point, heat accumulated in a thermal head in continuous printing heats the overall head and causes portions of the ink layer corresponding to unheated dots of the head to soften thereby facilitating the scumming of a receptor paper sheet. By contrast, since the second thermal transfer layer which is adapted to contact a receptor paper sheet has such a high softening point as described above, portions of the second thermal transfer layer corresponding to unheated dots will not soften even when heat is accumulated in a thermal head by continuous printing, thereby preventing the scumming of the receptor paper sheet.

The content of the specified ethylene-vinyl acetate copolymer in the heat-meltable material of the second thermal transfer layer is preferably not less than 50%. If it is less than 50%, the characteristics of the polymer will not be sufficiently reflected by the second thermal transfer layer.

The softening point of the second thermal transfer layer is suitably within the range of about 40° to about 90° C. in view of its thermal stability, transfer sensitivity and the like, preferably 60° to 90° C. when further taking account of the scumming preventability in continuous printing. The coating amount (on a dried amount basis, hereinafter the same) of the second thermal transfer layer is suitably within the range of about 0.5 to about 2 g/m$^2$.

In the present invention the first thermal transfer layer comprises a heat-meltable material and optionally a coloring agent, the heat-meltable material containing 20 to 100% of a resin having a glass transition point of not lower than 50° C. and a melt visocsity of not higher than $1\times10^4$ cps/160° C. (hereinafter referred to as "glassy resin").

If the melt viscosity of the glassy resin is higher than $1\times10^4$ cps/160° C., the first thermal transfer layer has a difficulty in permeating and penetrating through the second thermal transfer layer when subjected to printing, thus providing print images of poor fixability. If the melt viscosity is too low, the glassy resin will permeate a paper sheet too much and, hence, the melt viscosity thereof is preferably not lower than 10 cps/160° C. If the glass transition point of the glassy resin is lower than 50° C., resulting print images are poor in adhesive strength and hence suffer degraded fixability. Where the glass transition point of the glassy resin is too high, the transfer sensitivity of the first thermal transfer layer is degraded; therefore, the glass transition point of the glassy resin is preferably lower than 130° C.

Examples of the glassy resin include petroleum resins (such as polymers of $C_5$ aliphatic hydrocarbons, $C_5$ alicyclic hydrocarbons, or derivatives thereof and polymers of $C_9$ aromatic hydrocarbons, $C_9$ alicyclic hydrocarbons, or derivatives thereof), phenol resins, acrylic resins, styrene resins, styrene-acrylic monomer copolymers, rosin resins, pinene resins, coumarone-indene resins, and copolymer resins of these resins. These resins may be used either alone or as a mixture. The softening point of the glassy resin is suitably within the range of about 60° to about 140° C.

The content of the glassy resin in the heat-meltable material is preferably 20 to 100%. If the content of the glassy material is less than that range, the fixability of resulting print images is insufficient.

The heat-meltable material of the first thermal transfer layer may contain any one of the resins usable for the second thermal transfer layer as a component other than the glassy resin and may be incorporated with a minor amount of a wax.

The coating amount of the first thermal transfer layer is suitably within the range of about 0.5 to about 2 g/m$^2$.

In the present invention either or both of the first and second thermal transfer layers may contain a coloring agent.

Where both of the thermal transfer layers contain a coloring agent, it is easy to provide print images of an increased density.

Where the coloring agent is incorporated in the first thermal transfer layer but not in the second thermal transfer layer, the thermal transfer printing medium is excellent in scumming preventive property and hence prevents scumming even when subjected to continuous printing.

Where the coloring agent is incorporated in the second thermal transfer layer but not in the first thermal transfer layer, resulting print images are advantageously free of smudge due to rubbing.

The coloring agent may comprise any of conventional coloring agents for use in heat-meltable ink of this type, for example, various inorganic or organic pigments and dyes, including carbon black.

The content of the coloring agent is usually about 10 to 40% in the first thermal transfer layer and about 10 to 50% in the second thermal transfer layer.

In the present invention the release layer is a heat-meltable release layer containing a wax as a major component.

Usable as the wax of the release layer are those aforementioned for the second thermal transfer layer without any particular limitations.

As required, a small amount of a resin may be incorporated into the release layer for purpose of regulating the adhesion between the foundation and the first thermal transfer layer. Usable as such a resin are those resins for use in the first and second thermal transfer layers.

Preferably, the release layer has a melting point of about 60° to about 120° C. and is used in a coating amount of about 0.5 to 2 g/m$^2$.

Usable as the foundation are polyester films such as polyethylene terephthalate film, polyethylene naphthalate film and polyarylate film, polycarbonate film, polyamide films, aramid film and other various plastic films commonly used for the foundation of ink ribbons of this type. Otherwise, thin paper sheets of high density such as of condenser paper may be used. The thickness of the foundation is preferably within the range of about 1 to about 10 μm, particularly about 2 to about 7 μm, for better heat conduction.

On the back side (the side adapted to come into slide contact with a thermal head) of the foundation may be formed a conventionally known stick-preventive layer comprising one or more of various heat-resistant resins such as silicone resin, fluorine-containing resin, nitrocellulose resin, other resins modified with these heat-resistant resins including silicone-modified urethane resins, and mixtures of the foregoing heat-resistant resins and lubricating agents.

The present invention will be more fully described by way of examples and comparative examples thereof. It is to be understood that the present invention is not limited to these examples, and various changes and modifications may be made in the invention without departing the spirit and scope thereof.

EXAMPLES 1 to 3 and COMPARATIVE EXAMPLES 1 to 3

A 6 μm-thick polyethylene terephthalate film was used as having a 0.1 μm-thick silicone-modified urethane resin layer on the back side thereof. The other side of the film was coated with a solution of paraffin wax in toluene, which was then dried to form a release layer having a melting point of 70° C. in a coating amount of 1.0 g/m$^2$.

In turn, the release layer thus formed was coated with a coating liquid prepared by dissolving or dispersing the composition for the first thermal transfer layer appearing in Table 1 in a toluene-methyl ethyl ketone mixed solvent, followed by drying to form a first thermal transfer layer in a coating amount of 1.5 g/m$^2$. Note that Comparative Example 1 was not provided with the first thermal transfer layer.

Further, the first thermal transfer layer thus formed was coated with a coating liquid prepared by dissolving or dispersing the composition for second thermal transfer layer of the following formulation in a toluene-methyl ethyl ketone mixed solvent, followed by drying to form a second thermal transfer layer having a softening point of 50° C. and a melt viscosity of 1×10$^6$ cps/160° C. in a coating amount of 1.0 g/m$^2$.

In this way thermal transfer printing media were prepared.

Composition for second thermal transfer layer

| Ingredients | Parts by weight |
|---|---|
| Ethylene-vinyl acetate copolymer (vinyl acetate content: 28%, softening point: 46° C., melt viscosity: 1 × 10$^5$ cps/160° C.) | 70 |
| Carbon black | 30 |

TABLE 1

| | Ex. 1 | Ex. 2 | Ex. 3 | Com. Ex. 1 | Com. Ex. 2 | Com. Ex. 3 |
|---|---|---|---|---|---|---|
| Ingredients of ink compositiod (part by weight) | | | | | | |
| Hydrogenated alicyclic hydrocarbon petroleum resin*1 | 30 | 80 | — | — | — | — |
| Styrene-acrylic monomer copolymer resin*2 | — | — | 30 | — | — | — |
| Ethylene-vinyl acetate copolymer*3 | 50 | — | 50 | — | — | — |
| Polyester resin*4 | — | — | — | — | 80 | — |
| Phenol resin*5 | — | — | — | — | — | 80 |
| Carbon black | 20 | 20 | 20 | — | 20 | 20 |
| Physical properties of the ink composition | | | | | | |

TABLE 1-continued

| | Ex. 1 | Ex. 2 | Ex. 3 | Com. Ex. 1 | Com. Ex. 2 | Com. Ex. 3 |
|---|---|---|---|---|---|---|
| Softening point (°C.) | 40 | 110 | 50 | — | 120 | 70 |
| Melt viscosity (cps/160° C.) | $5 \times 10^5$ | $1 \times 10^4$ | $7 \times 10^5$ | — | $4 \times 10^5$ | $2 \times 10^3$ |

*[1]glass transition point: 60° C., softening point: 110° C., melt viscosity: $1 \times 10^3$ cps/160° C.
*[2]glass transition point: 70° C., softening point: 110° C., melt viscosity: $9 \times 10^3$ cps/160° C.
*[3]glass transition point: 30° C., softening point: 50° C., melt viscosity: $26 \times 10^4$ cps/160° C.
*[4]glass transition point: 70° C., softening point: 120° C., melt viscosity: $20 \times 10^4$ cps/160° C.
*[5]glass transition point: 35° C., softening point: 70° C., melt viscosity: 500 cps/160° C.

EXAMPLE 4

A thermal transfer printing medium was prepared in the same manner as in Example 1 except that the second thermal transfer layer was formed using the following composition.

Specifically, the aforementioned first thermal transfer layer was coated with a coating liquid prepared by dissolving or dispersing the composition for second thermal transfer layer of the following formulation in a toluene-methyl ethyl ketone mixed solvent, followed by drying to form a second thermal transfer layer having a softening point of 75° C. and a melt viscosity of $1 \times 10^6$ cps/160° C. in a coating amount of 1.0 g/m$^2$.

| Composition for second thermal transfer layer | |
|---|---|
| Ingredients | Parts by weight |
| Ethylene-vinyl acetate copolymer (vinyl acetate content: 19% softening point: 75° C., melt viscosity: $1 \times 10^5$ cps/160° C. | 70 |
| Carbon black | 30 |

EXAMPLE 5

A thermal transfer printing medium was prepared in the same manner as in Example 1 except that the second thermal transfer layer did not contain carbon black.

Each of the thermal transfer printing media prepared in the foregoing Examples and Comparative Examples was subjected to a printing test using a thermal transfer printer (PC-PR150V, a product of NEC Corporation) under the following conditions for evaluating its bridging transferability, fixability and scumming preventability. The results are shown in Table 2.

Printing conditions

Printing energy: 0.1 mJ/dot

Printing speed: 100 cps

Receptor paper: rough paper having a Bekk smoothness of 28 sec.

(1) Evaluation of bridging transferability

A solid print image obtained on a receptor paper sheet was measured for its reflection density (in OD value), which was evaluated according to the following ratings:

3 . . . 1.5 or greater

2 . . . 1 or greater and smaller than 1.5

1 . . . smaller than 1

(2 ) Evaluation of fixability

A printed letter obtained on a receptor paper sheet was rubbed 20 times with a plastic eraser applied with a load of 500 g, and the printed letter thus rubbed was evaluated according to the following ratings:

3 . . . no change

2 . . . legible

1 . . . illegible (3) Evaluation of scumming preventability

The aforesaid printing was performed under an environmental condition at 40° C., and scumming in the vicinity of a print letter was evaluated according to the following ratings:

3 . . . no scumming

2 . . . letter being legible despite scumming

1 . . . letter being illegible due to serious scumming

TABLE 2

| | Ex. | | | | | Com. Ex. | | |
|---|---|---|---|---|---|---|---|---|
| | 1 | 2 | 3 | 4 | 5 | 1 | 2 | 3 |
| Bridging transferability | 3 | 2 | 3 | 3 | 3 | 3 | 3 | 2 |
| Fixability | 2 | 3 | 2 | 2 | 2 | 1 | 1 | 2 |
| Scumming preventability | 3 | 2 | 3 | 3 | 3 | 3 | 3 | 1 |

The thermal transfer printing media obtained in Examples 1, 4 and 5 were evaluated for their scumming preventabilities under a more severe condition than the aforementioned (the temperature of the printing environment was changed to 50° C.). The results are shown in Table 3.

TABLE 3

| | Example | | |
|---|---|---|---|
| | 1 | 4 | 5 |
| Scumming preventability | 2 | 3 | 3 |

As apparent from Table 3, the thermal transfer printing medium of Example 4 using an ethylene-vinyl acetate copolymer of which the content of vinyl acetate was not greater than 20% as the heat-meltable material of the second thermal transfer layer was more excellent in scumming preventability at a high temperature than that of Example 1 using an ethylene-vinyl acetate copolymer of which the content of vinyl acetate was greater than 20%, and was equivalent to the thermal transfer printing medium of Example 5 having the second thermal transfer layer free of a coloring agent.

As has been described, a thermal transfer printing medium according to the present invention is excellent in both bridging transferability and fixability with respect to a rough paper sheet and hence assures clear print images free of voids and dropout portions even on the rough paper sheet. Further, with the thermal transfer printing medium of the present invention, high-speed printing is feasible without enhancing the printing energy since the first thermal transfer layer thereof is easy to soften or melt. Moreover, since the second thermal transfer layer has a high melt viscosity, the thermal transfer printing medium is less likely to stain a receptor paper sheet even when rubbed against the receptor sheet during printing and hence offers satisfactory scumming preventability.

Where the specified resin is used in the first thermal transfer layer of the thermal transfer printing medium, the medium assures print images of further improved fixability, as well as the above-mentioned advantages.

Where the heat-meltable material of the second thermal transfer layer contains 50 to 100% by weight of an ethylene-vinyl acetate copolymer of which the content of vinyl acetate is not greater than 20% by weight, the second thermal transfer layer has a raised softening point and hence keeps a receptor from scumming even in continuous printing.

What is claimed is:

1. A thermal transfer printing medium comprising a foundation, a release layer comprising a wax, a first thermal transfer layer comprising a heat-meltable material containing 20 to 100% by weight of a resin, said resin having a glass transition point of not lower than 50° C. and a melt viscosity of not higher than $1\times10^4$ cps/160° C., and a second thermal transfer layer comprising a heat-meltable material and having a melt viscosity of not lower than $1\times10^5$ cps/160° C., the release layer, the first thermal transfer layer and the second thermal transfer layer being provided in this order on the foundation, at least one of the first and second thermal transfer layers containing a coloring agent.

2. The thermal transfer printing medium of claim 1, wherein said resin contained in said heat-meltable material of said first thermal transfer layer comprises at least one resin selected from the group consisting of petroleum resins, phenol resins, acrylic resins, styrene resins, styrene-acrylic monomer copolymer resins, rosin resins, pinene resins, coumarone-indene resins, and copolymer resins of these resins.

3. The thermal transfer printing medium of claim 1, wherein said heat-meltable material of said second thermal transfer layer contains 50 to 100% by weight of an ethylene-vinyl acetate copolymer having a content of vinyl acetate of not greater than 20% by weight.

* * * * *